US011982149B2

(12) United States Patent
Burguieres

(10) Patent No.: US 11,982,149 B2
(45) Date of Patent: May 14, 2024

(54) INTRODUCTION AND MIXING OF SEPARATE LIQUID COMPOSITIONS CONTAINING REACTIVE COMPONENTS WITHIN A WELL

(71) Applicant: Philip Martial Burguieres, Houston, TX (US)

(72) Inventor: Philip Martial Burguieres, Houston, TX (US)

( * ) Notice: Subject to any disclaimer, the term of this patent is extended or adjusted under 35 U.S.C. 154(b) by 132 days.

(21) Appl. No.: 17/540,686

(22) Filed: Dec. 2, 2021

(65) Prior Publication Data

US 2023/0175342 A1 Jun. 8, 2023

(51) Int. Cl.

| | |
|---|---|
| ***E21B 33/12*** | (2006.01) |
| ***E21B 33/13*** | (2006.01) |
| *E21B 17/20* | (2006.01) |
| *E21B 27/02* | (2006.01) |
| *E21B 34/14* | (2006.01) |

(52) U.S. Cl.

CPC ..... *E21B 33/12* (2013.01); *E21B 33/13* (2013.01); *E21B 17/203* (2013.01); *E21B 27/02* (2013.01); *E21B 34/142* (2020.05)

(58) Field of Classification Search

CPC ..... E21B 33/12; E21B 33/13; E21B 34/142; E21B 17/203; E21B 27/02

USPC ..... 166/305.1

See application file for complete search history.

(56) References Cited

U.S. PATENT DOCUMENTS

| | | | | |
|---|---|---|---|---|
| 4,921,047 | A * | 5/1990 | Summers | E21B 43/025 166/276 |
| 4,972,906 | A * | 11/1990 | McDaniel | C09K 8/5086 166/313 |
| 5,314,023 | A * | 5/1994 | Dartez | E21B 33/13 166/278 |
| 9,863,226 | B2 * | 1/2018 | Lastra | E21B 27/02 |
| 10,851,620 | B2 * | 12/2020 | Hoffman | E21B 33/12 |
| 2011/0011593 | A1 * | 1/2011 | Borhaug | E21B 7/124 166/311 |
| 2019/0040858 | A1 * | 2/2019 | Khachaturov | H02K 1/12 |

* cited by examiner

*Primary Examiner* — Matthew R Buck
*Assistant Examiner* — Patrick F Lambe
(74) *Attorney, Agent, or Firm* — Jeffrey L. Streets

(57) ABSTRACT

A method includes introducing a first liquid composition into a well having a wellbore, introducing a second liquid composition into the well, and mixing the first and second liquid compositions within the well. The first liquid composition is kept separate from the second liquid composition until mixing the first and second liquid compositions within the well. Furthermore, the first liquid composition includes a first reactive component, the second liquid composition includes a second reactive component, and the first reactive component reacts with the second reactive component in response to mixing the first and second liquid compositions within the well. The method further includes causing the mixed compositions to engage the wellbore. In one example, the first reactive component may be an epoxy and the second reactive component may be a hardener that reacts with the epoxy to form a solid plug in the wellbore to seal off the well.

25 Claims, 6 Drawing Sheets

INTRODUCTION AND MIXING OF SEPARATE LIQUID COMPOSITIONS CONTAINING REACTIVE COMPONENTS WITHIN A WELL

BACKGROUND

The present disclosure relates to methods and apparatus for sealing a wellbore.

BACKGROUND OF THE RELATED ART

Oil wells and gas wells are bored down into the Earth to reach a geological formation that is expected to contain oil or gas. A great amount of planning, effort and expense goes into the drilling of each well, yet the amount of oil or gas production and the productive life of each well may vary. In some wells, a stimulation technique such as hydraulic fracturing may be employed to increase the amount of oil or gas produced from the well. In some wells, an enhanced oil recovery process may be used to extract a greater proportion of the oil within a particular formation.

The oil and gas industry has also developed a host of chemical compounds for various uses in wells. For example, particular chemicals have been injected into wells for the mitigation and prevention of scale, rust, gas hydrates, produced sand and produced water. Chemicals have also been used to reduce hydrostatic pressure on producing formations to initiate or increase flow by foaming or by reducing the specific gravity of the oil.

However, despite all the technology, techniques and processes available to improve production of a well and extend the life of a well, there comes a point at which the economics of the well will dictate that the well be taken out of production and be plugged off. Cement has often been used to seal a well during abandonment operations. However, polymers and other chemicals may be pumped into the wellbore to plug or seal off the well.

BRIEF SUMMARY

Some embodiments provide a method that includes introducing a first liquid composition into a well having a wellbore, introducing a second liquid composition into the well, and mixing the first and second liquid compositions within the well. The first liquid composition is kept separate from the second liquid composition until mixing the first and second liquid compositions within the well. Furthermore, the first liquid composition includes a first reactive component, the second liquid composition includes a second reactive component, and the first reactive component reacts with the second reactive component in response to mixing the first and second liquid compositions within the well. The method further includes causing the mixed compositions to engage the wellbore.

DETAILED DESCRIPTION

Figure 1:
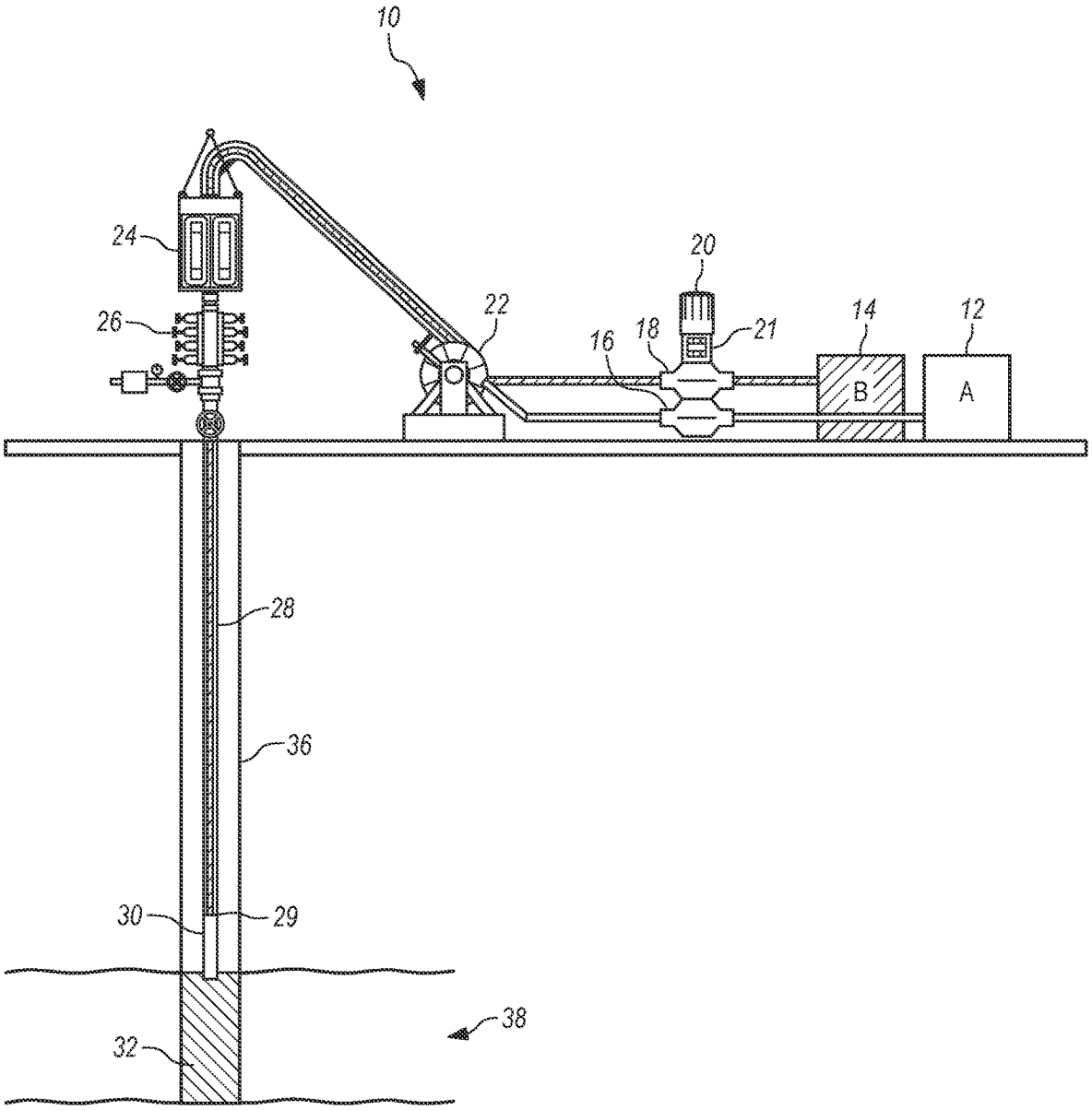
FIG. 1 is a diagram of an apparatus including bifurcated tubing for introducing two separate liquid compositions into the well and mixing the compositions within the well to initiate a reaction.

Some embodiments provide a method that includes introducing a first liquid composition into a well having a wellbore, introducing a second liquid composition into the well, and mixing the first and second liquid compositions within the well. The first liquid composition is kept separate from the second liquid composition until mixing the first and second liquid compositions within the well. Furthermore, the first liquid composition includes a first reactive component, the second liquid composition includes a second reactive component, and the first reactive component reacts with the second reactive component in response to mixing the first and second liquid compositions within the well. The method further includes causing the mixed compositions to engage the wellbore.

In some embodiments, the first reactive component is an epoxy resin, also known as a polyepoxide. Epoxy resins include a reactive epoxide functional group that allows the epoxy resins to react and cross-link with themselves through catalytic polymerization or with a wide range of co-reactants, such as polyfunctional amines, acids, acid anhydrides, phenols, alcohols and thiols. The co-reactants may be referred to as "hardeners" and the cross-linking reaction may be referred to as "curing." The reaction of epoxy resin with themselves or polyfunctional hardeners forms a thermosetting polymer. Such thermosetting polymers may have desirable physical properties, thermal stability and chemical resistance. In one option, the epoxy resin may include monomers, dimers, oligomers, or short chain polymers, so long as the epoxy resin can be transported in the first liquid composition. The second reactive component included in the second liquid composition may be any of the co-reactants or hardeners or may be a catalyst to support catalytic polymerization. Accordingly, keeping the first liquid composition including an epoxy resin separate from the second liquid composition containing a hardener or catalyst will prevent the curing reaction from occurring. Rather, the curing reaction between the epoxy resin and the hardener or catalyst cannot begin until the first and second liquid compositions become mixed.

In some embodiments, the first and second liquid compositions are introduced into a target region of the well, wherein the first and second liquid compositions are mixed at the target region of the well. Introducing or delivering the first and second liquid compositions to the target region of the well means that the first and second reactive components will not come into contact with each other until the first and second liquid compositions are mixed at the target region of the well. Introducing or delivering the first and second liquid compositions to the target region prior to mixing these compositions has several benefits over pumping a reacting mixture to the target region. One of the technical benefits is that there is no reaction occurring during the time required to pump the first and second liquid compositions to target region and, therefore, there is no appreciable change in viscosity of the compositions during the pumping. Further technical benefits may include avoiding the use of chemical retarders in the compositions intended to extend the cure time and avoiding wellsite personnel and equipment exposure to the reaction conditions and cleanup. Still further technical benefits may include reduced possibility of contaminating the first and second liquid compositions with solids and/or fluids in the wellbore and greater control over the final physical properties of the reaction product. These and other benefits of various embodiments may also reduce the cost of operations that are directed at causing the mixed compositions to engage the wellbore.

In some embodiments, the mixed compositions are caused to fill the wellbore in the target region of the well, wherein the first and second liquid compositions react to form a solid plug in the target region of the wellbore. For example, the solid plug may include a polymerized epoxy. Selection of the target region as well as the amount and content of the first and second liquid compositions may determine whether the solid plug isolates a downhole zone or seals off the entire well. For example, a solid plug may be used to plug one or more layers in a reservoir that is producing excessive brine, which technique may be referred to as a water shutoff treatment. Furthermore, the solid plug may be formed substantially within the wellbore or may extend from the wellbore through perforations into the formation.

In some embodiments, the step of introducing the first liquid composition into the well may include pumping the first liquid composition into the well through tubing that has been lowered into the well. Similarly, the step of introducing the second liquid composition into the well may include pumping the second liquid composition into the well through the tubing. Optionally, the tubing may be selected from coiled tubing and jointed pipe. However, the liquid compositions may be pumped into a first end of the tubing at the surface adjacent the wellhead and through the tubing to a distal end of the tubing positioned at a target region in the well.

In some embodiments, the tubing is a bifurcated tubing having first and second channels, and wherein the first liquid composition is pumped through the first channel and the second liquid composition is pumped through the second channel. Accordingly, the bifurcated tubing keeps the first and second compositions separated over the length of the tubing. One optional form of a bifurcated tubing is concentric tubing in which the first and second channels are concentric channels. Specifically, one channel may be an inner tube and the other channel may be an annular region between an outer tube and the inner tube. Optionally, the inner tube may be eccentrically disposed inside the outer tube, such that the inner and outer tubes do not share or do not necessarily share a central axis. Furthermore, the bifurcated tubing may include a single tubular structure with a barrier separating the cross-sectional area of the tubing into two channels. Furthermore, the first and second channels may have the same amount of cross-sectional area (i.e., open area perpendicular to the axis of the tubing) or some different amount of cross-sectional area. In one option, if a first channel is intended to carry a first volume of a first composition to a target region and a second channel is intended to carry a second volume of a second composition to the target region, and if the first volume is twice the second volume, then the cross-sectional area of the first channel may be greater than the cross-sectional area of the second channel, such as about twice the area of the second channel. In another option, if a first composition has a greater viscosity than and a second composition, then the channel intended to carry the first composition may have a greater cross-sectional area than the second channel intended to carry the second composition.

In some embodiments, the step of mixing the first and second liquid compositions within the well may include simultaneously pumping the first and second liquid compositions through a static mixer coupled in fluid communication with distal ends of the first and second channels of the bifurcated tubing within the well. A first end of the static mixer is open to the first and second channels and a second end of the static mixer is open to the wellbore. As the first and second liquid compositions are pumped through the static mixer, fixed plates or baffles cause the two separate fluid streams to become mixed. For example, the fixed plates or baffles may cause mixing to occur through flow division or radial mixing.

In some embodiments, the first liquid composition may be pumped through the first channel of the tubing at a first volumetric flow rate, the second liquid composition may be pumped through the second channel of the tubing at a second volumetric flow rate, and a ratio of the first and second volumetric flow rates may provide a predetermined ratio of the first and second liquid compositions through the static mixer before the mixed compositions engage the wellbore. Accordingly, the first and second volumetric flow rates may provide a predetermined volumetric ratio of the first and second liquid compositions through the static mixer so that the mixed liquid composition output from the static mixer is a mixture having the predetermined volumetric ratio. Mixing the first and second liquid compositions in a predetermined volumetric ratio is desirable so that the first and second reactive components are provided in a desired proportion to support a reaction that will yield the intended reaction product. For example, the physical properties of a solid plug intended to seal off a well are affected by the ratio of the reactive components used to form the solid plug. A predetermined ratio of the first and second reactive components may be produced in the well by knowing the concentration of the first reactive component in the first liquid composition, the concentration of the second reactive component in the second liquid composition and controlling the relative volumetric flow rates of the first and second liquid compositions to achieve the predetermined ratio. The actual volumetric flow rates of the first and second liquid compositions may be selected in conjunction with a selected static mixer diameter and a range of fluid velocity through the static mixer that will provide sufficient mixing.

In some embodiments, the first liquid composition may be pumped by a first pump coupled to the first channel of the tubing and the second liquid composition may be pumped by a second pump coupled to the second channel of the tubing. Specifically, an inlet to the first pump may be in fluid communication with a first storage container or tank holding the first liquid composition and an outlet from the first pump may be in fluid communication with the first channel of the tubing. Similarly, an inlet to the second pump may be in fluid communication with a second storage container or tank holding the second liquid composition and an outlet from the second pump may be in fluid communication with the second channel of the tubing. Accordingly, the first pump controls a volumetric flow rate of the first liquid composition from the first storage container or tank into the first channel and, ultimately, into the wellbore, and the second pump controls a volumetric flow rate of the second liquid composition from the second storage container or tank into the second channel and, ultimately, into the wellbore. In one option, the first and second pumps may be coupled to a single motor via a mechanical mechanism selected from a machined shaft, chain, belt and hydrostatic transmission such that the ratio of the volumetric flow rates from the first and second pumps may be fixed.

In some embodiments, the method may further include continuing to pump the first and second liquid compositions through the static mixer until delivering a predetermined quantity of the mixed compositions into the wellbore or until achieve a predetermined condition in the wellbore. Optionally, after delivering the predetermined quantity or achieving the predetermined condition, any remaining amount of the first liquid composition may be flushed back into a storage container and any remaining amount of the second liquid composition may be flushed back into a second storage container. It is possible to recover the first and second liquid compositions from the tubing since the first and second channels keep the first and second liquid compositions separated to avoid reactions and/or contamination therebetween.

In some embodiments of the method, the first and second liquid compositions may be sequentially introduced into the wellbore. For example, the first liquid composition may be pumped through the tubing into the wellbore before the second liquid composition is pumped through the tubing into the wellbore, wherein the first and second liquid compositions are mixed within the wellbore. Because of the sequential introduction of the first and second liquid compositions, tubing with a single channel may be used to introduce both the first liquid composition and the second liquid composition into the well and, ultimately, into the wellbore. However, sequential introduction of the first and second liquid compositions also renders a static mixer to be an ineffective means for mixing.

In some embodiments where the first and second liquid compositions are sequentially introduced into the wellbore, the first and second liquid compositions may be mixed within the wellbore by directing the second liquid composition from the tubing under pressure through a jet nozzle coupled to the tubing. The jet nozzle preferably directs the second liquid composition to be mixed into the first liquid composition within the wellbore. For example, the jet nozzle, or multiple jet nozzles, may be tangentially directed to induce some degree of swirling of the second liquid composition within the first liquid composition. In one option, the method may further include lowering and/or raising a distal end of the tubing so that the jet nozzle is submersed in the first liquid composition, which is already disposed in the wellbore, as the second liquid composition is directed from the tubing under pressure through the jet nozzle.

In some embodiments where the first and second liquid compositions are sequentially introduced into the wellbore, the method may further include inserting a wiper plug into the tubing between the first and second liquid compositions, wherein the wiper plug is pushed to a distal end of the tubing by pumping the second liquid composition into the tubing behind the wiper plug. The wiper plug may beneficially prevent any mixing of the first and second liquid compositions within the tubing.

In some embodiments involving sequential introduction of the first and second liquid compositions, the wiper plug is inserted into the tubing or pipe after the desired volume of the first liquid composition has been pumped into the tubing or pipe, and perhaps also into the well, but before the second liquid composition is pumped into the tubing or pipe. The wiper plug, such as a ball, is pumped down (displaced) to the bottom of the tubing or pipe with the appropriate volume of the second liquid composition. Upon reaching the mixing tool, the wiper plug may land in a "catcher". When the wiper plugs lands in the catcher, a noticeable increase in pump pressure may be caused, which indicates that the volume of the second liquid composition has reached the mixing tool at the distal end of the tubing. With continued high-pressure pumping of fluid above the wiper plug, the wiper plug and catcher may slide past a set of fluid jets for directing the second liquid composition into the first liquid composition at a high velocity.

In a further option, the second liquid composition may be followed by another fluid used to push the second liquid composition through the tubing and out the distal end into the wellbore. This other fluid may be non-reactive and may or may not be pushed out of the tubing. In another option, the volume of the second liquid composition may include both the volume that is intended to be mixed with the first liquid composition and the volume that is necessary to push the intended volume out of the tubing through the mixing tool.

In one implementation, after displacing the first liquid composition into the wellbore in the target region, the distal end of tubing or pipe string may be lowered so that the mixing tool is immerse in the previously displaced first liquid composition. Then, the second liquid composition is pumped into the first liquid composition. The mixing tool may be configured to ensure that both the first and second liquid compositions are put into turbulent flow and thoroughly mixed so that the first and second reactive components may begin to react. The mixed compositions are then left in the target region of the well to further react and the tubing or pipe can be retrieved or readied for an additional application. In applications wherein the first and second reactive components include an epoxy and a hardener/catalyst, the reaction may be a curing reaction that forms a solid epoxy plug that seals off the target region of the well.

In some embodiments, the steps of introducing the first liquid composition into the well and introducing the second liquid composition into the well may include lowering a tool into the well, wherein the tool includes a first chamber containing the first liquid composition and a second chamber containing the second liquid composition. For example, the tool may be a vessel, such as a bailer, that is lowered into the well on jointed pipe, coiled tubing, electric wireline or slickline. After lowering the tool into the well, the step of mixing the first and second liquid compositions within the well may include simultaneously forcing the first and second liquid compositions out of the first and second chambers through a static mixer coupled in fluid communication with the first and second chambers and into the wellbore. In one option, the first and second liquid compositions may be forced out the first and second chamber, respectively, by applying pressure to the top of the first and second chambers.

Compared to methods that mix reactive components at the surface and then pump the mixed and actively reacting components into a well, the present embodiments prevent the reactive components from mixing and reacting (i.e., catalyzing) until after the reactive components have been introduced into the well. Specifically, some embodiments may prevent the reactive components from mixing and reacting until the compositions containing those reactive components are delivered to a target zone of the well. Some embodiments that include downhole mixing and reacting of the reactive components may provide greater operational flexibility, less potential for contamination of the reactive components, less potential for worker exposure to reaction conditions, reduced or eliminated need for hazardous cleaning chemicals, less waste of reactive components, and potentially lower cost. One or more of these benefits may be achieved in either a simultaneous introduction through bifurcated tubing, a sequential introduction through single-channel tubing, or introduction using a dual-chambered tool such as a bailer.

FIG. 1 is a diagram of an apparatus or system 10 including bifurcated tubing 28 for introducing two separate liquid compositions ("A" and "B") into a well 36 and mixing the compositions within the well in order to initiate a reaction. In some embodiments, the objective of the operation may be to form a solid plug 32 within a target region 38 of the well 36.

A first storage tank 12 may store a first liquid composition (A) containing a first reactive component and a second storage tank 14 may store a second liquid composition (B) containing a second reactive component. Optionally, the first and second liquid compositions may include any number of components, whether reactive or non-reactive, but the components within the first liquid composition should not undergo a reaction independent of the second liquid composition, and the components within the second liquid composition should not undergo a reaction independent of the first liquid composition. As a result, both first and second liquid compositions are stable until mixed together.

A first pump 16 has an inlet port in fluid communication with the first storage tank 12 via an inlet pipe and an outlet port in fluid communication with a first channel of bifurcated tubing 28 via an outlet pipe. The first pump is operated to draw the first liquid composition A from the first storage tank 12 and deliver the first liquid composition A into the first channel of the bifurcated tubing 28. A second pump 18 has an inlet port in fluid communication with the second storage tank 14 via an inlet pipe and an outlet port in fluid communication with a second channel of bifurcated tubing 28 via an outlet pipe. The second pump is operated to draw the second liquid composition B from the second storage tank 14 and deliver the second liquid composition B into the second channel of the bifurcated tubing 28. A tubing reel 22 may be provided and may include fluidic connections between the outlet pipes from the first and second pumps 16, 18 to the first and second channels of the tubing.

The first pump 16 and the second pump 18 may be operated by a single motor 20, or each pump 16, 18 may be operated by a separate motor. However, the first and second pumps 16, 18 may be controlled to achieve a predetermined ratio of volumetric flow rates, such as twice the volumetric flow rate of the first liquid composition A as the volumetric flow rate of the second liquid composition B. A mechanical timing mechanism 21, such as a machined shaft, chain, belt or hydrostatic transmission, may be employed between the motor 20 and the pumps 16, 18 to establish the predetermined ratio that may be required for proper catalyzation or other reaction.

In the illustrated embodiment, a coiled tubing injector 24 is suspended above the wellhead 26 to allow the coiled tubing 28 to be raised and lowered in the well 36. The tubing 28 may be inserted into the well 36 until the distal end 29 supporting the static mixer 30 reaches the target region 38. With the distal end of the tubing in a desired position, the pumps 16, 18 are operated to deliver the first and second liquid compositions, in the predetermined ratio, into the first and second channels of the bifurcated tubing 28, through the static mixer 30, and into the wellbore below or around the static mixer 30. The first and second reactive components of the first and second liquid compositions, respectively, begin to react upon mixing in the static mixer 30 and will continue to react in the wellbore to form the solid plug 32.

After a sufficient total volume of the mixture has been delivered into the wellbore to form the solid plug, the tubing 28 may be withdrawn from the well 36. Optionally, any of the first and/or second liquid compositions that was not used or contaminated may be flushed back into the appropriate storage tank to be used later. Only the end of the mixing device should have any of the reaction products, such as catalyzed or hardened polymer, that may require cleanup, greatly reducing handling and cleanup costs.

Figure 2A:
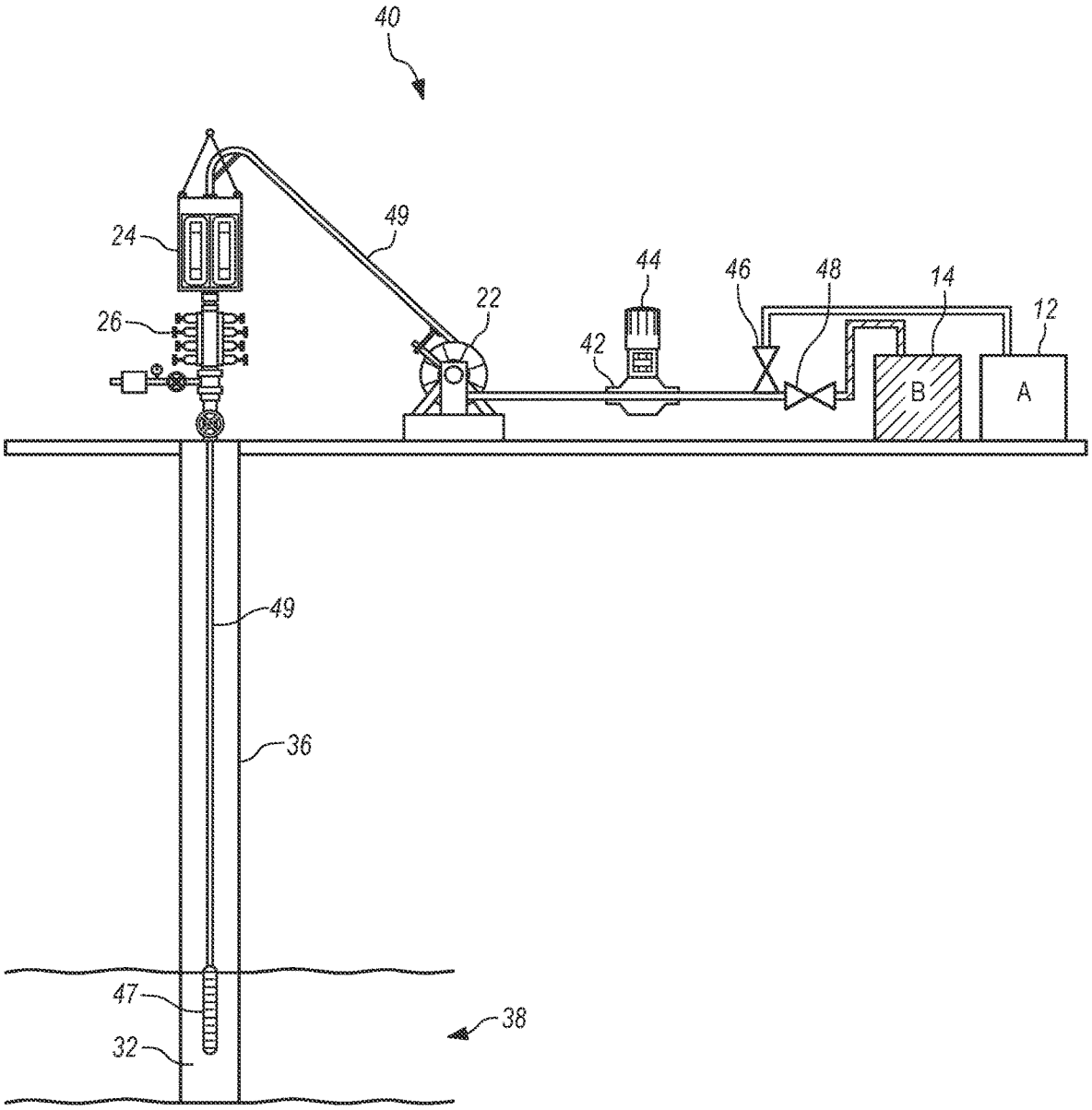
FIGS. 2A-B are diagrams of an apparatus for sequentially introducing two separate liquid compositions into the well and mixing the compositions within the well to initiate a reaction.
Figure 2B:
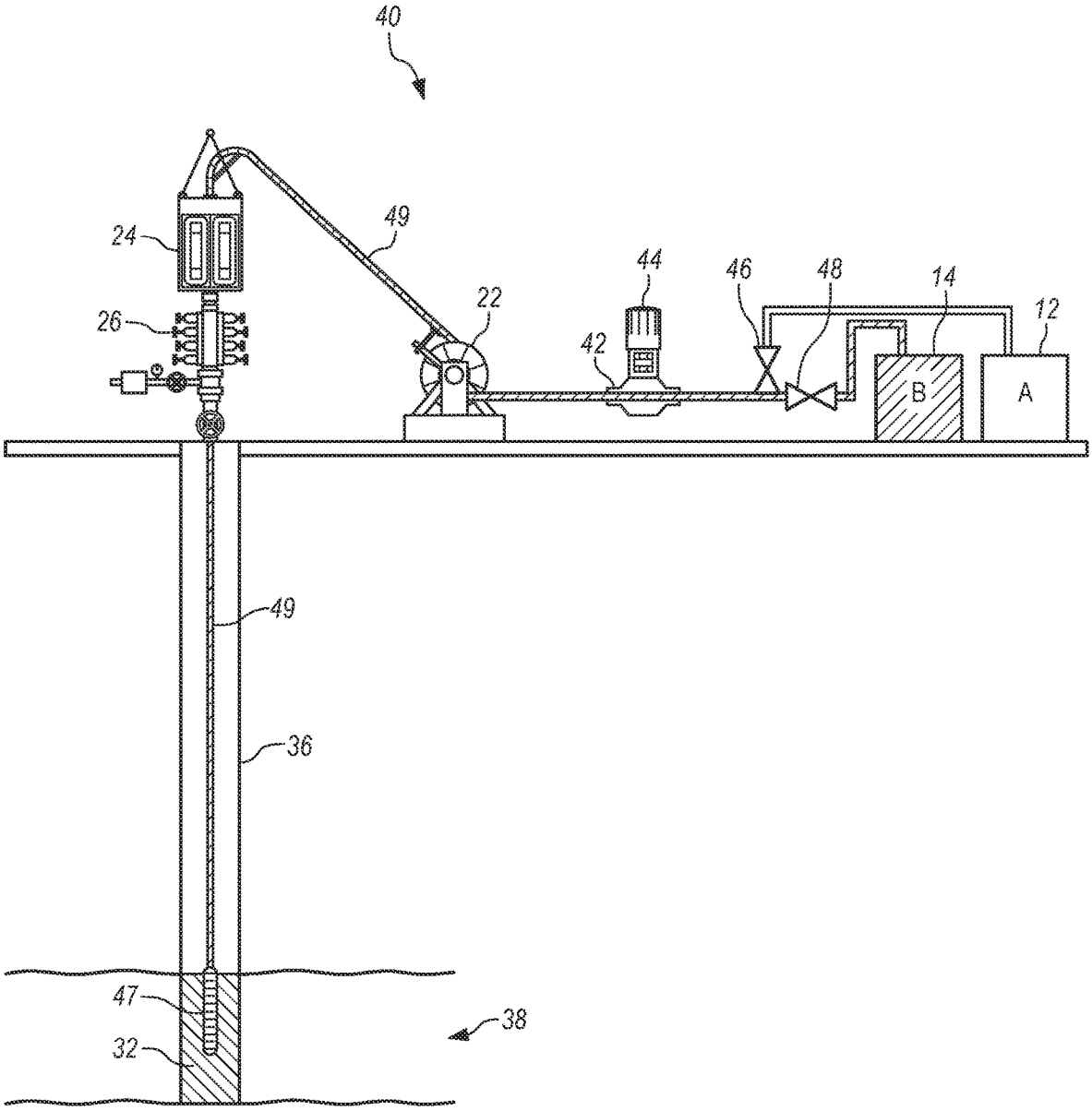

FIGS. 2A-B are diagrams of an apparatus or system 40 for sequentially introducing two separate liquid compositions ("A" and "B") into the well 36 and mixing the compositions within the well in order to initiate a reaction. In some embodiments, the objective of the operation may be to form a solid plug 32 within a target region 38 of the well 36. In FIGS. 2A-B, equipment and structures that are like those in FIG. 1 may be referred to using the same reference number.

In reference to FIG. 2A, the first storage tank 12 may store the first liquid composition (A) containing the first reactive component and the second storage tank 14 may store the second liquid composition (B) containing the second reactive component. Optionally, the first and second liquid compositions may include any number of components, whether reactive or non-reactive, but the components within the first liquid composition should not undergo a reaction independent of the components within the second liquid composition, and the components within the second liquid composition should not undergo a reaction independent of the components within the first liquid composition. As a result, both first and second liquid compositions are stable until mixed together.

A pump 42 is coupled to a motor 44 has an inlet port that may be placed in fluid communication with the first storage tank 12 via an inlet pipe and a first valve 46. The inlet port of the pump 42 may also be placed in fluid communication with the second storage tank 14 via the inlet pipe and a second valve 48. Opening the first valve 46 and turning on the pump 42 causes the first liquid composition to be pumped from the first storage tank 12 into the tubing 49. After enough of the first liquid composition A has been pumped into the tubing 49 and/or the wellbore, the pump 42 may be turned off, the first valve 46 may be closed, the second valve 48 may be opened, and the pump may be turned back on.

In reference to FIG. 2B, with the first valve 46 closed and the second valve 48 open, turning on the motor 44 that is coupled to the pump 42 causes the second liquid composition B to be pumped from the second storage tank 14 into the tubing 49. In one option, the second liquid composition B is pumped into the tubing 49 behind the first liquid composition A. With continued pumping, the first liquid composition is forced out a distal (lower) end of the tubing 49 into a target region 38 of the well 36. Subsequently, the second liquid composition is forced out the distal end 47 of the tubing 49 into the target region 38 of the well 36 to be mixed with the first liquid composition that has already been delivered into the wellbore in the target region 38 of the well 36. In another option, the first liquid composition A is completely dispensed into the well prior to introducing the second liquid composition B into the tubing.

Figure 3:
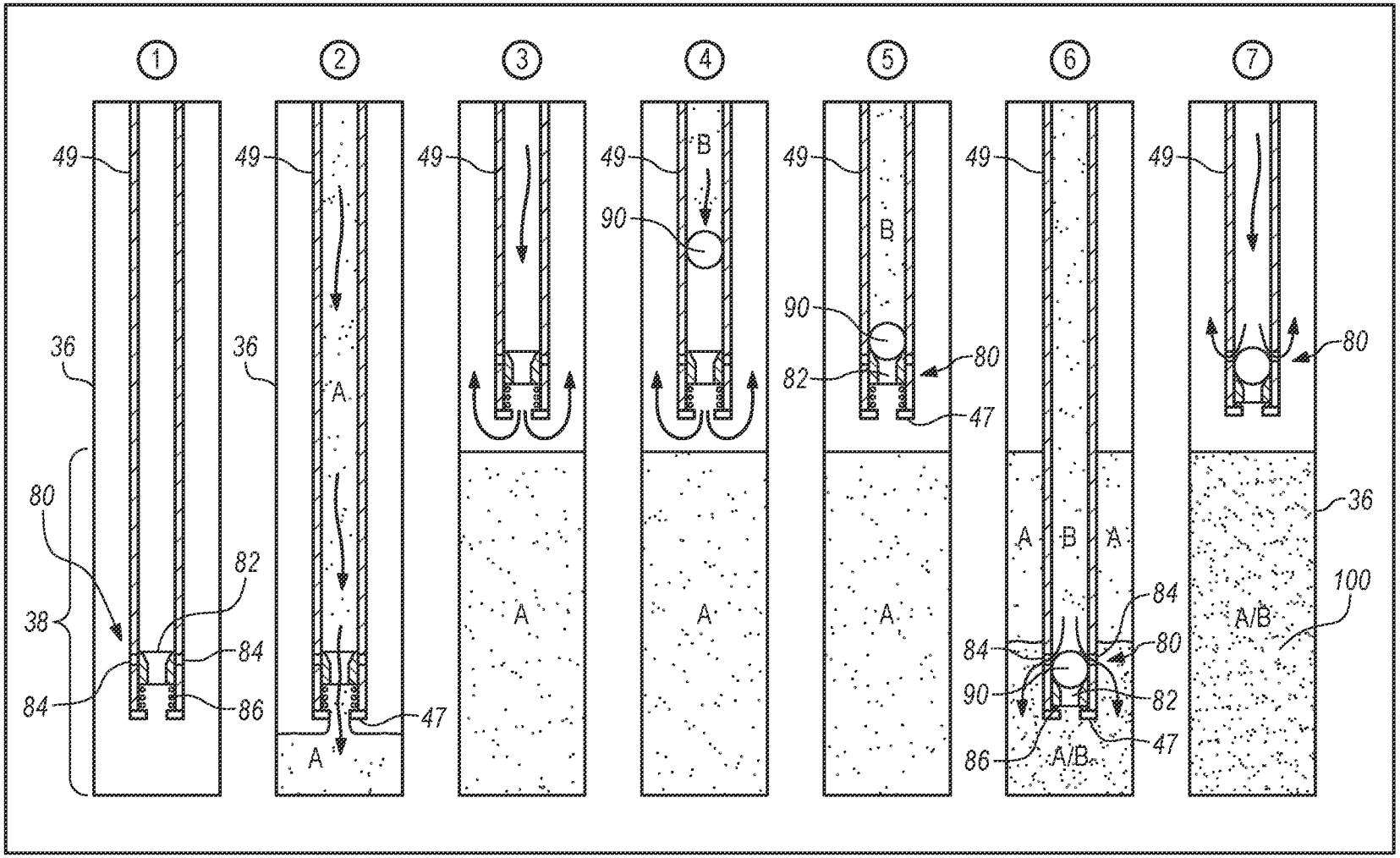
FIG. 3 is a diagram of seven steps or operations involved in a process of sequentially introducing two separate liquid compositions into the well and mixing the compositions within the well to initiate a reaction.

FIG. 3 is a diagram of seven steps or operations involved in a process of sequentially introducing two separate liquid compositions into the well and mixing the compositions within the well to initiate a reaction. The operations and components of FIG. 3 may be used in the system 40 of FIGS. 2A-B. The seven steps or operations are shown in sequence from left to right.

In step 1, the tubing 49 is lowered into the target region 38 of the well 36 for the application of the first and second liquid compositions. A bottom hole assembly (BHA) 80 consists of a ball seat receptacle within a sliding sleeve 82 and a set jetting ports 84 through the tubing wall. Until the ball lands in the ball catcher, the sliding sleeve remains in an upward position, perhaps assisted by a spring 86, to block flow through the jetting ports 84.

In step 2, the first liquid composition A is displaced through the tubing 49 in the required quantity until it is dispensed out the distal end 47 and into the well 36.

In step 3, the tubing 47 is raised so that the bottom hole assembly 80 is above the dispensed first liquid composition A. As the second liquid composition B is pumped down the tubing 47, other fluids are displaced out of the tubing and are not directed into the first liquid composition A. In this manner, no contaminating fluids are mixed in the first liquid composition A.

In step 4, a ball (wiper plug) 90 is placed into the tubing 49 and pumped down the tubing in front of second liquid composition B. Other fluids within the tubing 49 ahead of the ball 90 are displaced into the well above the first liquid composition A.

In step 5, the ball 90 is captured (lands) by the ball seat receptacle of the sliding sleeve 82. In this position, the ball 90 blocks flow through the distal end of the tubing 49. As a result of the tubing becoming blocked, an increase in pumping pressure can be detected at the surface. This higher fluid pressure indicates that the second liquid composition B has reached the bottom hole assembly 80.

In step 6, the tubing 49 is lowered so that the distal end 47 including the bottom hole assembly 80 is positioned into the previously displaced volume of the first liquid composition A. Then, the pump pressure on the second liquid composition B is increased to a pressure that pushes the ball 90 and sliding sleeve 82 to move downward against the spring 86. The lowering of the sliding sleeve 82 within the tubing 49 exposes the jetting ports 84 around the circumference of the tubing. With the jetting ports open, the second liquid composition B will be forced through the jetting ports into the first liquid composition A under significant pressure in turbulent flow. The turbulent flow of the second liquid composition B into the first liquid composition A causing substantial mixing of the two compositions.

In step 7, the tubing 49 is gradually raised and/or lowered through the region of the well containing the first liquid composition A as the required volume of second liquid composition B is displaced from the tubing. Once all of the second liquid composition B is fully displaced from the tubing, the tubing can be raised out of the mixed compositions and circulated to ensure any remaining mixture of the composition is flushed from the bottom hole assembly 80. The entire volume of the mixed compositions A/B is left to remain and cure in place within the well 36 to form a plug or seal 100.

Figure 4A:
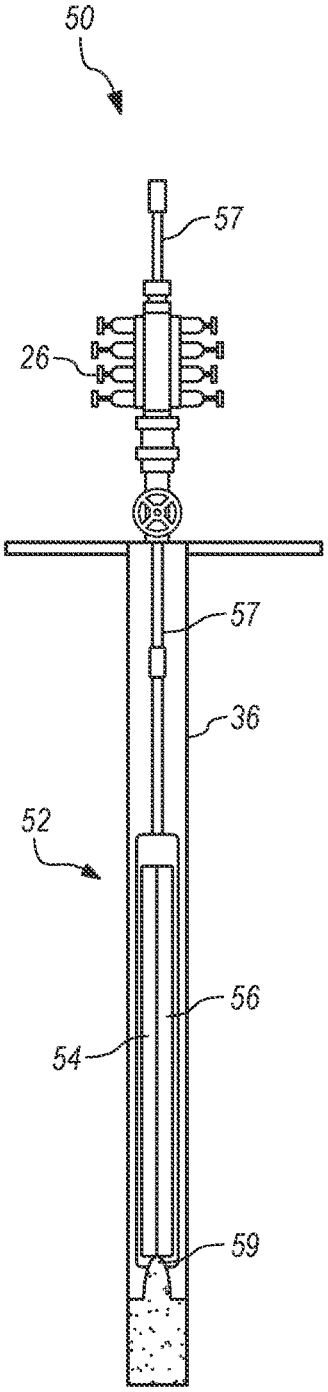
FIGS. 4A-B are diagrams of an apparatus including a dual-chamber tool containing two separate liquid compositions that is lowered into the well prior to mixing the compositions within the well to initiate a reaction.

FIG. 4A is a diagram of an apparatus or system 50 including a dual-chamber tool 52. The tool 52 includes a first chamber 54 containing the first liquid composition A and a second chamber 56 containing the second liquid composition B. The tool 52 is lowered into the well 36 prior to mixing the compositions within the well to initiate a reaction. In FIG. 4A, the tool 52 is shown having been lowered on the end of a jointed pipe 57 but could also be lowered on coiled tubing, electric wireline or slickline as shown in system 70 of FIG. 4B. The tool 52 keeps the first and second liquid compositions separate in their respective chambers 54, 56 until the tool has been lowered into a position in or near a target region of the well 36 where the first and second liquid compositions will be dispensed into the wellbore.

Once the tool 52 is in a desired location within the well, the tool may be activated to force the two chemical components through a mixing chamber 59 that ensures proper mixing of the first and second liquid compositions. The compositions are mixed as they pass through the mixing chamber 59 and are then directed out of the mixing chamber and into the desired location of the well. Upon mixing, the reactive components of the first and second liquid compositions may begin to catalyze or otherwise harden or react.

Figure 4B:
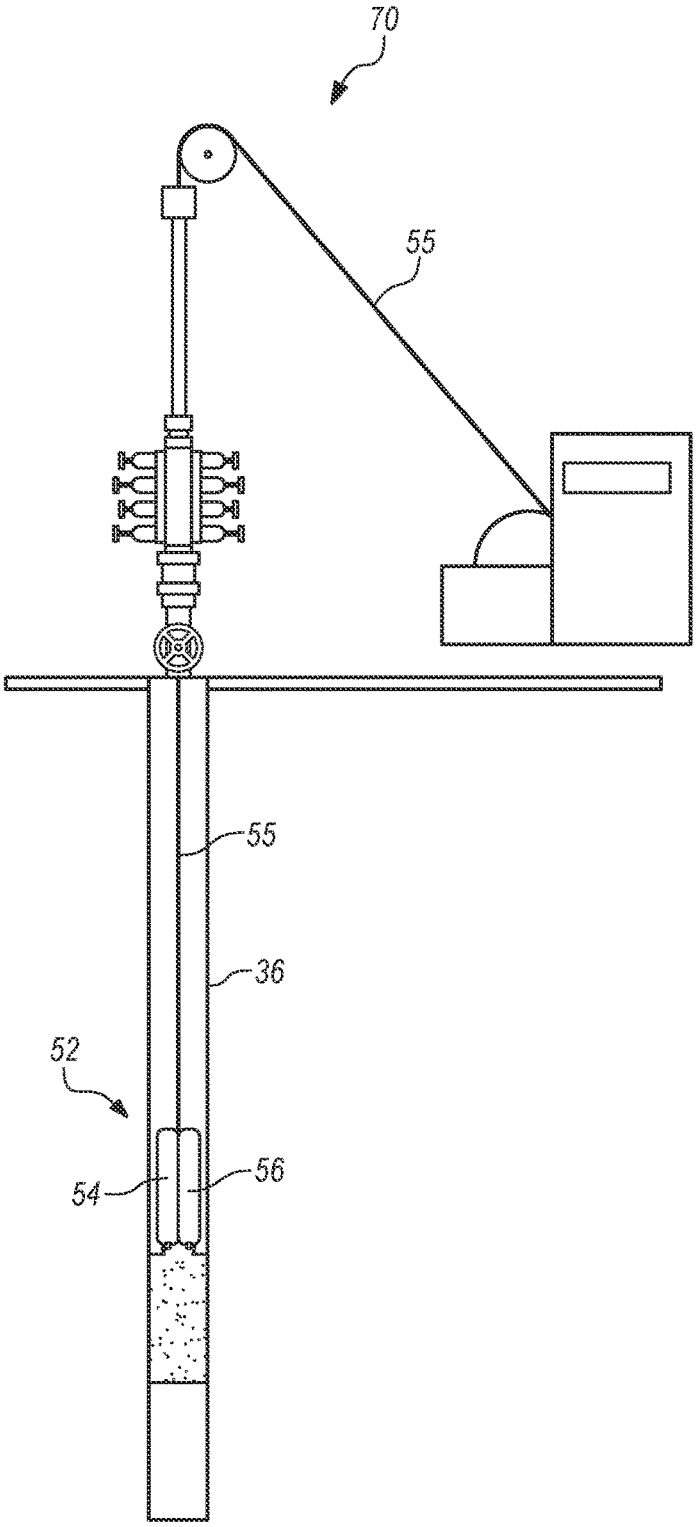

FIG. 4B is a diagram of an apparatus or system 70 similar to the system 50 in FIG. 4A, except that the tool 52 is lowered on an electric wireline or slickline 55. Otherwise, the tool 52 may be operated as described in reference to FIG. 4A to mix and dispense the first and second liquid compositions into the wellbore in the target region of the well 36.

Figure 5A:
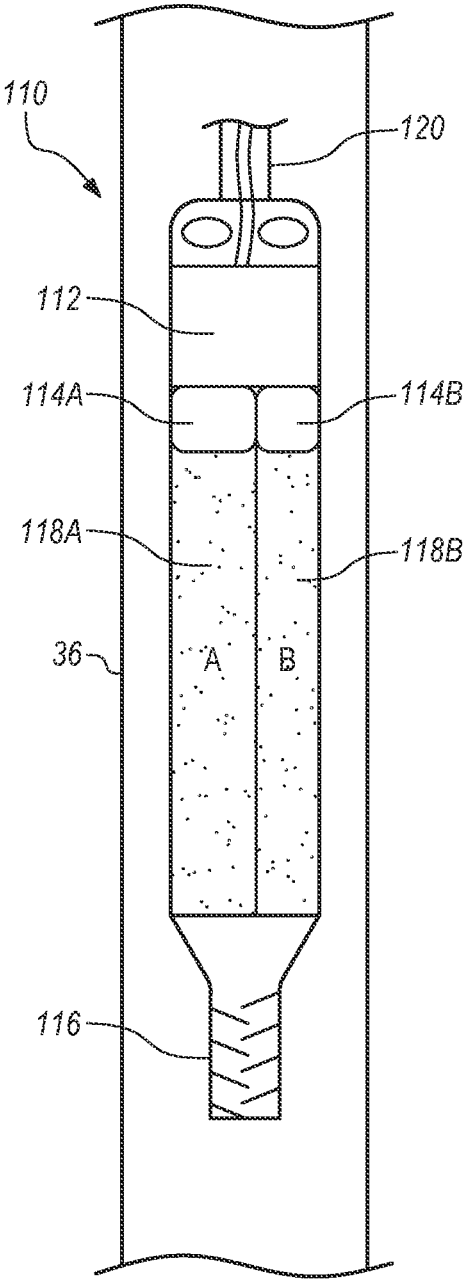
FIGS. 5A-B are diagrams of the dual-chamber tool including an electric pump and a pair of plungers for discharging the two separate liquid compositions through a static mixer and into the well.
Figure 5B:
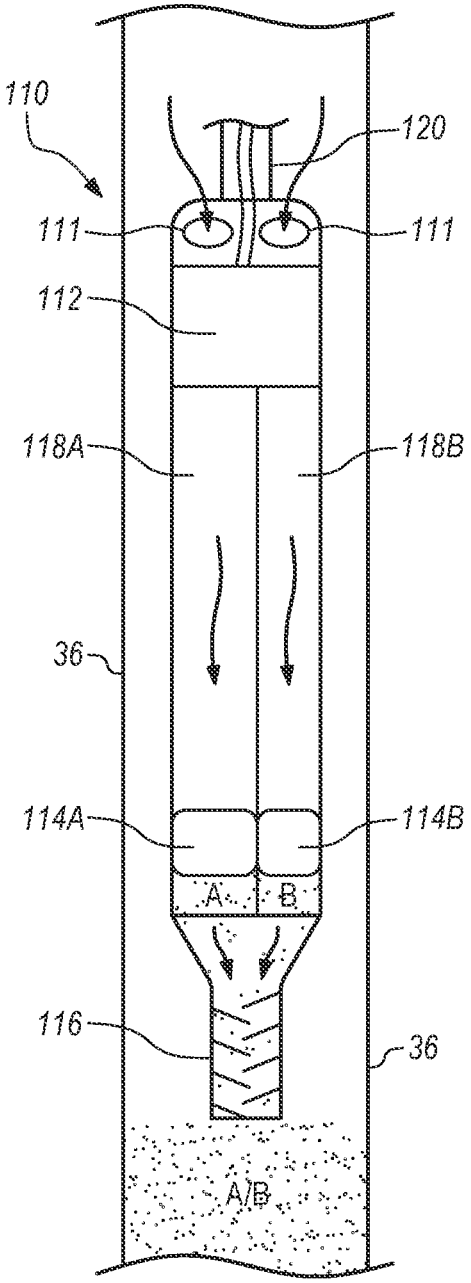

FIGS. 5A-B are diagrams of a dual-chamber tool 110 including an electric pump 112 and a pair of plungers 114 for discharging the two separate liquid compositions (A and B) through a static mixer 116 and into the well 36. The dual-chamber tool 110 may be used in the system 50 or system 70 of FIGS. 4A-B, such as in place of tool 52.

The first and second liquid compositions A and B are loaded into separate chambers 118A, 118B of the tool 110. Compositions A and B are prevented from reacting while in the tool 110 due to being kept in the separate chambers. The tool 110 is then lowered into the well 36 on electric wireline 120 that provides electrical power to the pump 112.

The tool 110 may be supported by the electric wireline 120 such that the electric pump 112 may be controllably activated from the surface. The pump 112 draws in well fluids through a set of inlet ports 111 and directs the compressed fluid against a pair of plungers 114A, 114B. As fluid continues to be pumped into the tool, the plungers 114A, 114B compress the compositions A and B, respectively, forcing the composition through the static mixer 116. The compositions A and B are mixed as they pass through the static mixer at the same time, the reactive components begin reacting, and the mixed compositions are deposited in the target region of the well 36. The chambers 118A, 118B may have a cylindrical cross-sectional shape and may be sized to provide the desired volumetric ratio of the first and second compositions (A and B).

The foregoing methods may be controlled by a computer executing a computer program product that includes program instructions for implementing or initiating any one or more aspects of the methods described herein. Accordingly, some embodiments may include a computer program product comprising a non-volatile computer readable medium and non-transitory program instructions embodied therein, the program instructions being configured to be executable by a processor to cause the processor to perform various operations of the methods. Still further, some embodiments may include an apparatus as disclosed for performing the methods, such as the apparatus shown in the Figures. However, some embodiments of the apparatus may be directed to, or further include, a controller or apparatus comprising at least one non-volatile storage device storing program instructions and at least one processor configured to process the program instructions, wherein the program instructions are configured to, when processed by the at least one processor, cause the apparatus to perform various operations of the methods.

As will be appreciated by one skilled in the art, embodiments may take the form of a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a computer program product embodied in one or more computer readable medium(s) having computer readable program code embodied thereon.

Any combination of one or more computer readable storage medium(s) may be utilized. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device. Furthermore, any program instruction or code that is embodied on such computer readable storage media (including forms referred to as volatile memory) that is not a transitory signal are, for the avoidance of doubt, considered "non-transitory".

Program code embodied on a computer readable storage medium may be transmitted using any appropriate medium, including but not limited to wireless, wireline, optical fiber cable, RF, etc., or any suitable combination of the foregoing. Computer program code for carrying out various operations may be written in any combination of one or more programming languages, including an object-oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Embodiments may be described with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, and/or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored on computer readable storage media is not a transitory signal, such that the program instructions can direct a computer, other programmable data processing apparatus, or other devices to function in a particular manner, and such that the program instructions stored in the computer readable storage medium produce an article of manufacture.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A method, comprising:

lowering an entire tool into a well having a wellbore, wherein the tool includes a first chamber containing a first predetermined quantity of a first liquid composition that includes a first reactive component and a second chamber containing a second predetermined quantity of a second liquid composition that includes a second reactive component, wherein the first reactive component is an epoxy resin and the second reactive component is a catalyst or a co-reactant;

mixing the first and second liquid compositions within the well, wherein the first liquid composition is kept separate from the second liquid composition until mixing the first and second liquid compositions within the well, wherein the first reactive component reacts with the second reactive component in response to mixing the first and second liquid compositions within the well, and wherein the epoxy resin and the second reactive component react to form a thermosetting polymer; and causing the mixed compositions to be dispensed into the wellbore in a target region of the well to form a solid plug of the thermosetting polymer in the target region of the wellbore.

2. The method of claim 1, further comprising:

causing the mixed compositions to fill the wellbore in the target region of the well.

3. The method of claim 2, wherein the second reactive component is a catalyst that supports catalytic polymerization of the epoxy resin.

4. The method of claim 1, wherein the first and second liquid compositions are substantially free of reaction retarding chemicals.

5. The method of claim 1, wherein mixing the first and second liquid compositions within the well includes simultaneously forcing the first and second liquid compositions out of the first and second chambers through a mixing chamber coupled in fluid communication with the first and second chambers and into the wellbore.

6. The method of claim 5, wherein the mixing chamber is a static mixer.

7. The method of claim 6, wherein the tool is a bailer.

8. The method of claim 6, wherein the tool is lowered into the well on jointed pipe, coiled tubing, electric wireline or slickline.

9. The method of claim 6, wherein the mixing chamber is disposed at a lower end of the first and second chambers, and wherein the first and second liquid compositions are simultaneously forced out the first and second chambers through the mixing chamber by applying pressure to the top of the first and second chambers.

10. The method of claim 5, further comprising:

lowering the tool into the position in or near the target region of the well; and activating the tool to dispense the first and second liquid compositions from the first and second chambers through the mixing chamber and release the mixture of the first and second liquid compositions into the well.

11. The method of claim 10, wherein the tool includes an electric pump and the tool is lowered into the well on an electric wireline that provides electrical power to the electric pump, and wherein the tool include a first plunger for discharging the first liquid composition from the first chamber through a static mixer into the well, and a second plunger for discharging the second liquid composition from the second chamber through the static mixer and into the well.

12. The method of claim 11, further comprising:

controllably activating the electric pump over the electric wireline.

13. The method of claim 11, wherein activating the electric pump causes the pump to draw in well fluids through an inlet port and compresses the well fluid against the first and second plungers.

14. The method of claim 13, further comprising:

causing the pump to continue compressing the well fluid against the first and second plungers so that the first and second plungers compress the first and second liquid compositions in the first and second chambers and force the first and second compositions through the static mixer to become mixed and deposited into the target region of the well.

15. The method of claim 11, wherein the first and second chambers each have a cylindrical cross-sectional shape.

16. The method of claim 1, wherein the first predetermined quantity of the first liquid composition and the second predetermined quantity of a second liquid composition provide a desired ratio of the first and second liquid compositions.

17. The method of claim 1, wherein the first and second reactive components begin to react upon mixing and continue to react in the wellbore to form the solid plug.

18. The method of claim 1, wherein the second reactive component is a co-reactant that that cross-links with the epoxy resin.

19. The method of claim 1, wherein the second reactive component is a co-reactant selected from polyfunctional amines, acids, acid anhydrides, phenols, alcohols and thiols.

20. The method of claim 1, wherein the epoxy resin includes monomers, dimers, oligomers, or short chain polymers.

21. The method of claim 1, wherein the solid plug isolates a downhole zone.

22. The method of claim 1, wherein the solid plug isolates one or more layers in a reservoir that is producing excessive brine.

23. The method of claim 1, wherein the solid plug seals off the entire well.

24. The method of claim 1, wherein the solid plug is formed substantially within the wellbore.

25. The method of claim 1, wherein the solid plug extends from the wellbore through perforations into a geological formation.

* * * * *